US005331896A

United States Patent [19]

Sullivan, Jr.

[11] Patent Number: 5,331,896

[45] Date of Patent: Jul. 26, 1994

[54] PROCESS FOR VISUALIZATION OF A DETONATION WAVE

[75] Inventor: John D. Sullivan, Jr., Edgewood, Md.

[73] Assignee: The United States of America as represented by the Secretary of the Army, Washington, D.C.

[21] Appl. No.: 93,163

[22] Filed: Jul. 16, 1993

[51] Int. Cl.[5] ..... F42B 3/00; F42B 25/12

[52] U.S. Cl. ..... 102/322; 102/323; 102/363; 102/701

[58] Field of Search ..... 102/322, 323, 363, 701

[56] References Cited

U.S. PATENT DOCUMENTS

| | | | |
|---|---|---|---|
| 3,687,076 | 8/1972 | Friant et al. | 102/24 |
| 4,132,169 | 1/1979 | Gay et al. | 102/6 |
| 4,132,170 | 1/1979 | Hardy et al. | 102/6 |
| 4,157,928 | 6/1979 | Falterman et al. | 149/109.2 |
| 4,493,262 | 1/1985 | Hutcheson | 102/363 |
| 4,969,398 | 11/1990 | Lundwall | 102/293 |

OTHER PUBLICATIONS

U.S. S.I.R. #H 161, Sullivan, Jr, Nov. 4, 1986.

*Primary Examiner*—Peter A. Nelson

*Attorney, Agent, or Firm*—Freda L. Krosnick; Walter R. Baylor

[57] ABSTRACT

Steps of a process for visualization of a detonation wave involve examining, measuring, and confirming a fuel-air explosion by using a ground-based fuel bottle oriented horizontally whereby the explosive dissemination creates a fuel-air cloud with its diameter in the vertical plane and a timed delay, proximate charge explodes within the created cloud. A ground-based high speed camera with a line-of-sight, end-on position with respect to the bottle, photographically records the existence of any occurring detonation wave.

3 Claims, 2 Drawing Sheets

PROCESS FOR VISUALIZATION OF A DETONATION WAVE

GOVERNMENTAL INTEREST

The invention described herein may be manufactured, used, and licensed by or for the United States Government without payment to me of any royalty thereon.

BACKGROUND OF THE INVENTION

1. Field of Invention

The present invention relates to a process for visualization of a detonation wave which process photographically proves or confirms the existence of the detonation wave for a wide range of fuel-air mixtures.

2. Description of the Prior Art

The prior art of detecting detonation in a fuel-air mixture employs an arrangement of a ground-based canister of fuel and a high-speed camera mounted in a high tower, far above the ground. Further, the prior art of detecting detonation in a fuel-air mixture largely consists of using pressure gauges and high-speed cameras. If each of the gauges arranged in a row or a line discloses a peak pressure of 300 psi (more or less) in a detonating fuel-air mixture, it is accepted that a detonation wave has passed though the mixture. If processed high-speed film reveals a bright front of fire consuming the mixture at 5900 feet/second (more or less), it is accepted that a detonation wave has passed through the mixture. These two detection methods—especially the gauge method—are used in laboratory detonation tests. In a field test of fuel-air explosives (FAE's), it is common to use both methods in the same test. It is to be noted that detonation and explosion are separate and distinct operations in the FAE prior art.

Detonation is defined . . . as an exothermic reaction which propagates at supersonic velocity. Explosion is defined as a rapid exothermic reaction at subsonic velocities . . . it will be understood that detonation of a fuel-air cloud is always the desired goal, rather than explosion of such cloud which would be accompanied by overpressures of lesser magnitude. Detonation occurs only over an area in which the volume percent of fuel in air in the cloud is within certain fairly well defined upper and lower limits generally referred to as the detonability limits. Ordinarily a time delay of a few seconds is introduced between impact of the device and detonation of the cloud to allow for fuel dispersal time and for the cloud to grow in size over some desired area. Any factor which affects fuel dispersal or cloud growth may inhibit the development of the desired fuel-air ratio over this area . . . If the volume percent of fuel in such a cloud exceeds the upper detonability limit of the fuel, then no detonation will occur and the device is not completely successful even though the possibility of burning or explosion may still exist; (Column 1 of U.S. Pat. No. 3,955,509 to Carlson, issued May 11, 1976). This patent disclosure is incorporated herein by reference.

State of the art fuel-air explosive (FAE) weapons require two distinct events for a successful detonation. The first event is dispersal of a fuel into either a large gas cloud or a two phase cloud of very small fuel droplets and air. A gas cloud is formed from compressed gas, while a two phase cloud is formed from a liquid, such as propylene oxide. Either type fuel may be used, and in both cases, formation of the cloud relies upon a high-explosive central burster that not only ruptures the bomb case but also imparts a very high radial velocity to the fuel. The time required for cloud formation is a function of several factors, size of central burster, amount of fuel, type of fuel, configuration of central burster, and weapon configuration . . . Once the cloud has been formed, a detonation is initiated by introducing a minimum amount of energy into the cloud at nearly the instant it reaches the proper fuel-air ratio . . . The generally adopted method has been to use a high explosive charge. The size of the charge depends on the fuel-air ratio of the cloud and on the proximity of the charge to the cloud. The detonation of the explosive charge is considered the second event in a fuel-air explosion, and the system that deploys that charge is termed the second event system, or the cloud detonator system . . . A successful fuel-air explosion requires a rather precise system to initiate detonation of the cloud. The high explosive charge must be placed directly in the cloud if a minimum size charge is used, since the amount of explosive required to initiate the cloud increases quickly as the distance from the cloud increases. The timing of the detonation of the initiating charge is also critical because the time during which the cloud is detonable is a very short. (Column 1 of U.S. Pat. No. 3,999,482 to Bilek, issued Dec. 28, 1976). This patent disclosure is incorporated herein by reference.

The process of the present invention concerns novel steps involving an arrangement of a high-speed camera and an unconfined fuel-air mixture. In the field use, a FAE mixture is usually generated by explosively disseminating liquid fuel from a canister. The dissemination breaks the bulk liquid into droplets that are propelled into the cloud, which is not thick, but of a large diameter. A second, time-delayed explosion actually initiates the fuel-air explosion. Applicant's pending U.S. application Ser. No. 07/953,165 filed Sep. 29, 1992 relates to FAE canister apparatus; this application disclosure is incorporated herein by reference. Examples of liquid fuel in the prior art are disclosed in the above-mentioned U.S. Pat. Nos. 3,955,509 and 3,999,482; also in U.S. Pat. Nos. 4,157,928 and 4,132,169.

3. Advantages Over the Prior Art

The detection steps of the process of the present invention constitute an important distinction over the photographic arrangement of the prior art. The process is not associated with the prior art electronic means of detection. The process of the invention involves the steps of examining, measuring, and confirming a fuel-air-explosion by using an elevated fuel bottle oriented horizontally so that the explosive dissemination will create a fuel-air cloud with its diameter in the vertical plane. In practicing the present process with ground-based components, a high-speed camera with a line-of-sight, end-on positioned with respect to the fuel jug or canister, can film the detonation (or burn) as it happens.

A fuel jug set upright in a vertical position will operatively produce a substantially circular shaped cloud whose thickness will be several jug (canister) heights. When the cloud is viewed from the side with a ground mounted camera, the cloud appears to be substantially rectangular shaped. When the cloud is viewed with an overhead mounted camera a substantially circular shape is revealed. A typical FAE cloud is actually shaped like a pillbox. Accordingly, it is fair to state that FAE clouds present a different appearance depending on the geometry between the observer and fuel bottle.

The detonation detection and confirmation result of the process of the present invention is made possible by understanding how actual cloud shape, viewpoint, and light scattering from the cloud affect and detract from camera-based detection systems.

a. Advantages Over the Side-On View: When viewed through the side of the cloud, the detonation wave does not have a sharply discernible front. The reason is that the detonation wave originates at the explosive-initiation point, which is deep within the cloud. The light from the detonation is scattered by all the droplets between the wave front and the camera. The scattering makes the location of the wave very imprecise. Another problem with the side-on view is that non-detonating pockets in the (inhomogeneous) fuel-air mixture are not revealed. It should be noted that these problems with the side-on view are not present when the fuel in the fuel-air mixture is in a gaseous state, rather than a droplet state. These detonations can be effected in laboratory and field experiments using shock tubes with windows or large, clear plastic bags. It is in the two-phase (gas and liquid/air) detonations effected by fuel jugs, that the process of the present invention is definitely required.

b. Advantages over the Overhead View: When the cloud is viewed from overhead, the problems of the side-on view disappear. As a general rule, the detonation front can be easily located and the smooth or jerky movement of the detonation wave can be seen over the whole cloud, depending on the homogeneity. Some disadvantages of the overhead view are the requirements for the high capital investment for equipment and the complexity of the apparatus. A high, safe tower (or a sky-wire nexus of three towers) and special camera-aiming equipment are required. Thus, the use of an overhead camera is a prior art solution to the problem of obtaining a proper visualizing of the detonation wave.

The process of the present invention has the advantages of the overhead view type and none of its disadvantages. The useful result attained by the prior art is also obtained by the present process in a simpler and direct manner, that is, both the cloud and the detonation wave are photographed at ground level. Both the growth of the cloud and the speed of the detonation wave can be measured. With the process of the invention, much survey work on fuel-air explosions can be performed faster and with fewer operators. With the correct parameters known, improved research and testing can be conducted and repeated with the fuel bottle placed conventionally and slightly elevated, and with a line of pressure gauges installed.

SUMMARY OF THE INVENTION

The present invention relates to a process for examining, measuring, and confirming a fuel-air explosion by operatively using a fuel bottle oriented horizontally in a slightly elevated position whereby the resulting explosive dissemination creates a fuel-air cloud with its diameter in the vertical plane. A ground-based high-speed camera that is mounted with a line-of-sight, end-on position with respect to the bottle can operatively record the detonation. The results flowing from practicing this process improve research and testing in fuel-air explosives.

Accordingly, it is an object of the present invention to provide a process for visualization of a detonation wave in proving or confirming detonation in a fuel-air mixture.

It is another object of the invention to provide a process for visualization of a detonation wave to screen fuels for their detonability.

It is another object of the invention to provide a process for visualization of a detonation wave for a number of study areas; namely, cloud growth, size and placement of the initiators, countermine effectiveness and combustibility.

It is another object of the invention to provide a process of visualization of a detonation wave that is simple to practice and renders a visualization of the detonation wave that is easy to interpret.

Other objectives of the present invention will be apparent from the following detailed description of the invention.

DETAILED DESCRIPTION OF THE INVENTION

The invention relates to a process for visualization of a detonation wave utilizing novel steps involving an arrangement of a high-speed photographic field type camera and a fuel-air explosion (FAE) mixture generated by explosively disseminating liquid fuel from a fuel jug or canister. The process uses, but is not limited to, the fuel-air explosive apparatus as described in the above-mentioned pending U.S. application Ser. No. 07/953,165 by Applicant. The reference canister apparatus comprises a standard plastic beverage bottle, a plastic burster tube, a conventional detonator, a detonating cord, Teflon ® tape, and a liquid fuel. All of the components of this FAE canister are readily available and are standard materials. The FAE canister of the 07/953,165 application is structurally the same as the FAE canister of the present invention. Further, reference numbers used in the instant application follow the sequence of numbers in the 07/953,165 application.

Figure 1:
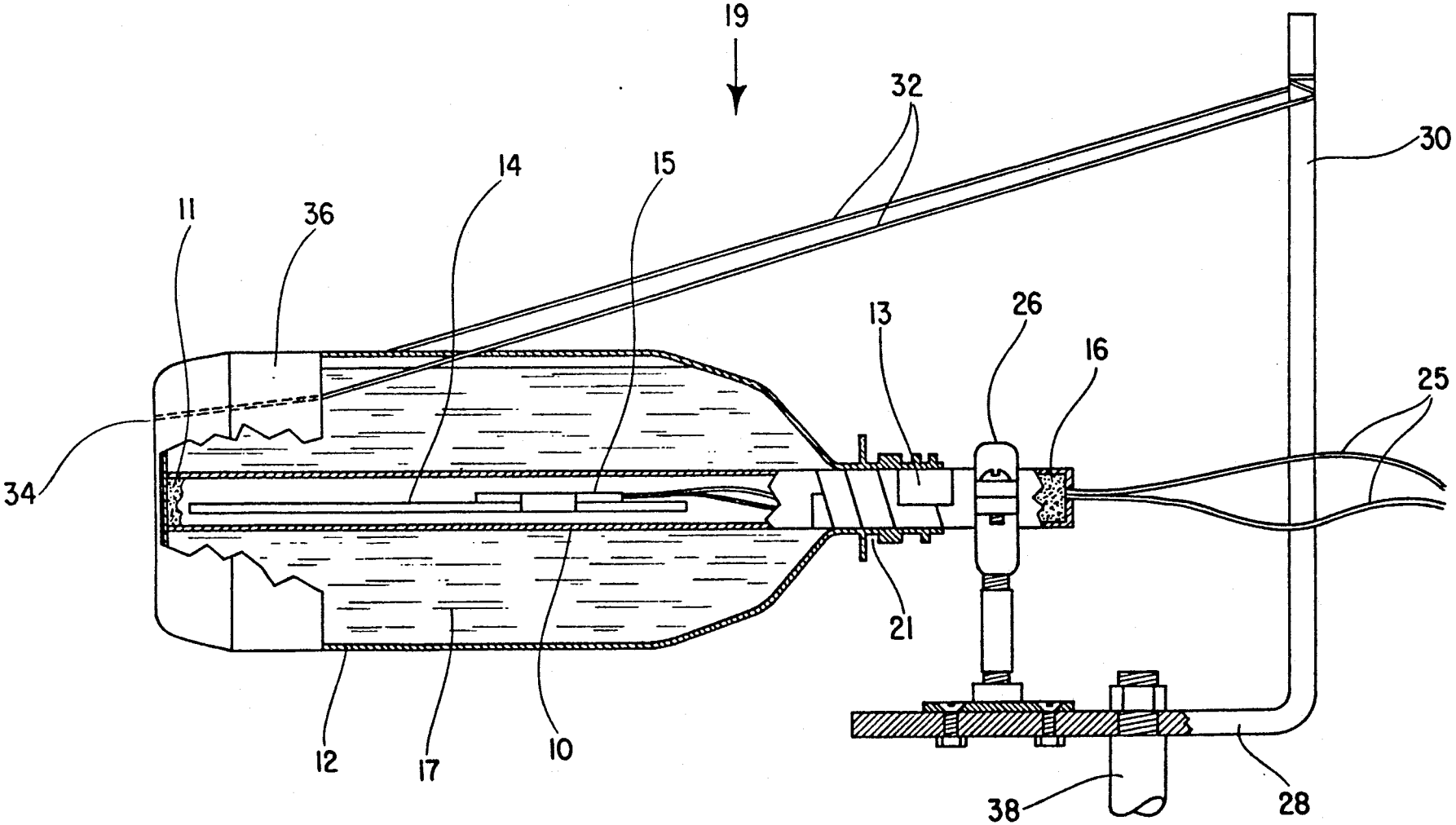
FIG. 1 shows a cross sectional view of a mounted FAE bottle in accordance with the present invention.
Figure 2:
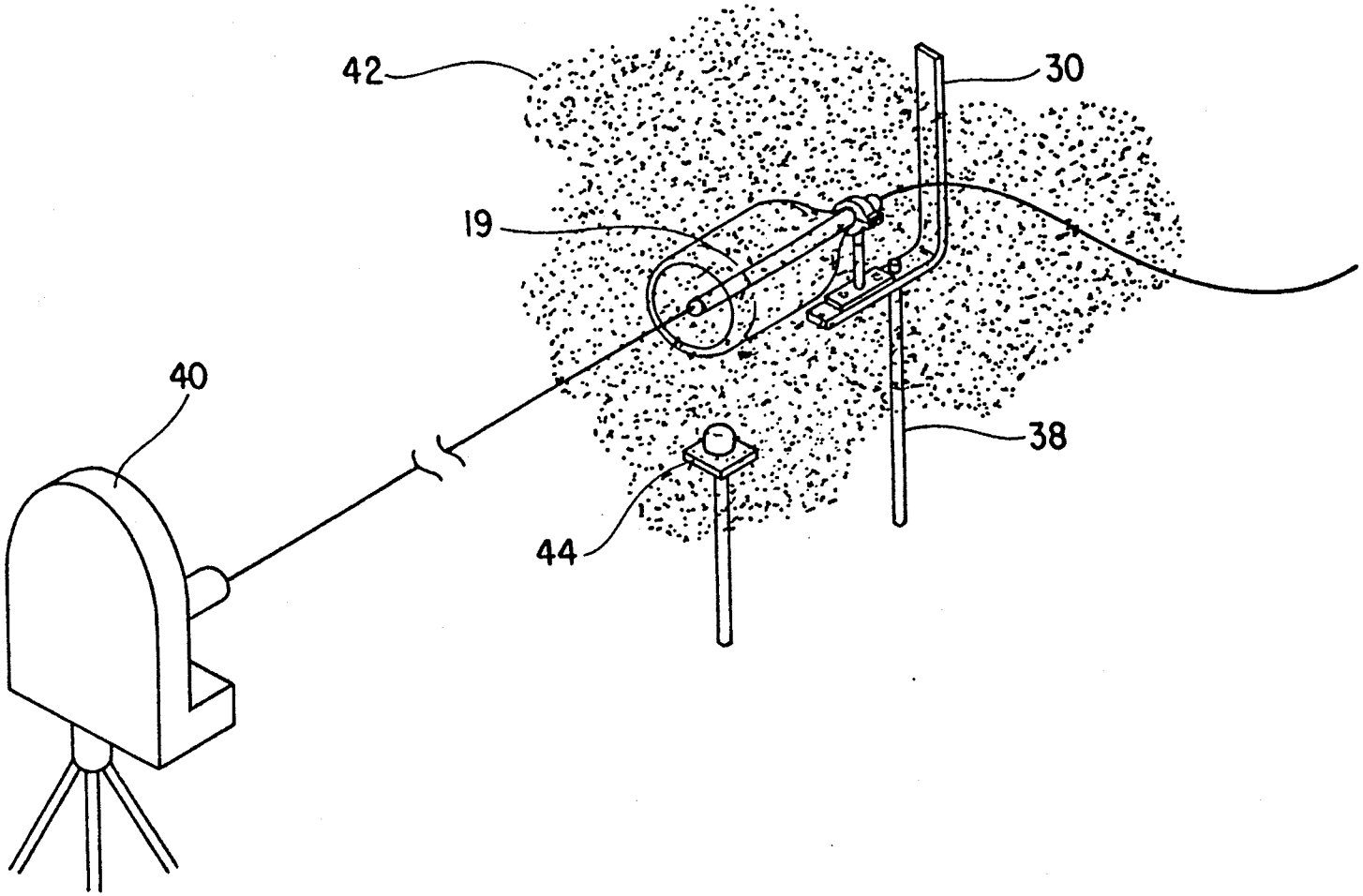
FIG. 2 shows a schematic view of a combination of a camera and the FAE bottle in accordance with the invention.

FIG. 1 of the present invention shows a FAE canister device 19 which. is a plastic, standardized soft drink bottle 12. The bottle 12 may be of various available and standard sizes; i.e., 0.5-, 1-, 1.5-, 2-, or 3-liter. A burster tube 10 (which is a commercial plastic PVC pipe) is slideably inserted through a bottle neck 21 of the bottle 12. The burster tube 10 is sealed at the end entering into the bottle 12 with an epoxy cement 11. A Teflon ® tape 13 is wound around the tube 10 at the appropriate neck location and provides a seal between the tube 10 and the bottle neck 21. The burster tube 10 is loaded with a detonating cord 14 and a detonator 15. The top of the burster tube 10 is packed with a putty 16. Two detonator wires 25 extend through the putty 16 and are attached to an electric firing line (not shown). When the detonating cord 14 is activated, the resulting shock wave and expanded gases, as shown in FIG. 2, created by the activation, break the bottle 12 and push out a liquid fuel 17. Accordingly, the liquid fuel 17 is atomized into droplets and subsequently forms a cloud of fuel-air which is detonated at a specific delay time by a high explosive.

An important step of the process is the location of the bottle 12 in a horizontal plane with respect to the earth's ground surface. Since the bottle 12 is leakproof, it is possible and practical to mount the bottle 12 in a horizontal position in lieu of a vertical position. The burster tube 10 extends outside the bottle neck 21 and is supported by one end of a pipe hanger device 26 which securely grips the burster tube 10. The other end of the pipe hanger device 26 constitutes a base member that is secured to a horizontal leg 28 of a reverse L-shaped bracket. The horizontal bracket leg 28 together with the pipe hanger 26 constitutes a horizontal supporting platform for the bottle 12. Vertical leg 30 of the reverse L-shaped bracket is a vertical support for receiving a cord or string 32. One end of the string 32 is wrapped several times around the vertical bracket leg 30 and the other end is pulled through two drain holes 34 (one hole on each side) on a base cap 36 of the bottle 12. The string 32 assists in tightly holding the bottle 12 in the horizontal position. Thus, the bottle 12 with the bracket 28, 30 and the wrapping string 32 support the bottle 12 in a secure and fixed horizontal position. The horizontal bracket leg 28 is supported by a vertical elevator-type pole 38; thereby, the central axis of the bottle 12 is above and parallel to the ground.

From a safe operating distance, about 100 feet for a 2-liter bottle, a high-speed camera 40 is mounted on the ground oriented horizontally and is focused at the bottle 12. For reference, a measuring length standard, about a one-meter ribbon and a test number should be used in the operation. When the camera 40 reaches a speed of about 4000 frames/second, the bottle 12 is broken open by firing the burster tube 10. A fuel-air cloud of fuel is filmed as a white disk-shaped type cloud 42 which grows until force of the burster explosion is dissipated. Because of the horizontal mounting of the bottle 12, the disk-shaped cloud 42 is located face-on to the camera 40. The size of the cloud 42 depends on a number of factors, such as amount and type of fuel. For example, with two liters of fuel, frames of a movie show the cloud 42 has stopped growing by 66 milliseconds and will be in the range of 13 to 14 feet in diameter. Propylene oxide may be selected as the fuel. Further an explosion in the range of $\frac{1}{8}$ to $\frac{1}{4}$ pound of a high explosive 44 interior to the cloud 42 may or may not start a detonation that will proceed throughout the cloud 42. Thereby it is readily seen that a photograph derived from the processed film will confirm if a detonation wave has occurred.

What the process utilizes is the concept of positioning the bottle 12 in a low aerial horizontal position, and the positioning of the camera 40 also in a low aerial position. FIG. 2 shows the high-speed camera 40 pointed at the center of the fuel-air cloud 42, which was the location of the end-on positioned bottle 12, before the explosive dissemination phase of the operation.

It can be shown by using the appropriate practices, procedures, and equipment that the mounting bracket 28, 30 and the pole 38 will survive the explosion. The bracket 28, 30 and the pole 38 are preferably made of metal with sturdy characteristics. A proximate charge 44 placed within the cloud 42, will explode and initiate the FAE mixture.

In practicing the process of the present invention, the bottle 12 is gripped on the protruding burster tube 10 by the pipe hanger 26. This cantilever attachment can cause a 2-liter and larger sized bottles to sag or sink to one side. The act of sinking makes the burster tube 10 noncoincident with the central axis of the bottle 12, so configuration of the cloud 42 is asymmetrical. To move the bottle 12 so that it assumes a horizontal position, the string 32 is pulled through the two drain holes 34 in the base of the bottle 12 and is fastened to the vertical bracket leg 30. The pipe hanger 26 which is secured to the horizontal bracket leg 28 constitutes a horizontal platform structure for the bottle 12.

As noted above, various size bottles may be utilized. As the size of the bottle 12 increases, the elevator pole 38 must be raised higher so the cloud 42 clears the ground. To avoid difficult setup work beyond the range of the operator's reach, the entire mount can be arranged beforehand at the workbench. It is only necessary to fill the bottle 12 with water, insert, and clamp the (empty) PVC tube 10 and tie off the leveled bottle 12. The bottle 12 is then unclamped, but left tied to the vertical bracket leg 30. Instead of waiting for the bottle to drain or dry out, a small amount of fuel can be swished in the bottle 12 and poured out, purging it of water. With actual loading of the bottle 12 and the tube 10 completed, the last step is to install the bottle mount means on the elevator pole 38 and raise the pole 38 to the height required to give the cloud ground clearance.

The process is not especially weather-sensitive except during electrical storms when explosive handling must obviously cease. Overcast reduces the daylight for filming the fuel cloud, but the detonation itself is a self-luminous event and can be filmed at night as well as day. Loaded with film of ASA 400, the camera with a speed of 4000 frames/second will overexpose the film for the detonation if a large aperture, for example, f/3.3 setting is used. The overexposure will only degrade the image, but there would still be proof of the detonation.

It is occasionally desirable to use pin-registered framing cameras, instead of, or in addition to, the rotating-prism type camera used in very high-speed photography, because there is a sharper image. However, their top speed of 500 frames/second is not sufficient to film a detonation wave. At 500 frames/second, a detonation wave will cross a small bottle's cloud in one frame and the white cloud will disappear. So, indirectly, a non-detonation is proved. If an explosion occurs instead of a detonation, the camera speed will clearly show the slow engulfment of the cloud by the fireball from the proximate high-explosive charge. In between detonation and explosion is a partial detonation, wherein the wave forms dies out before crossing the entire cloud. Such an event can be detected only with a high-speed camera. Inference from a 500 frames/second film would incorrectly classify the test as a detonation.

The influence of the camera speed is two-fold: first, a high frame-rate gives more photographs in the time it takes the detonation wave to traverse the cloud and, second, it reduces image smear. Further, the location of the detonation wave front was previously called imprecise because the droplets scattered the light from the chemical reaction. Apart from this problem is the one of identifying the physical extent of the reaction zone, the supersonic burning region. Because the detonation wave is moving fast, the bright head within the cloud will give a smeared size, even with a narrow reaction zone, during the film frame's exposure time. The smearing can be reduced by shortening the exposure time, which in turn is controlled through the shutter opening and the frame rate of the camera. The relationship is as follows:

Exposure time = shutter opening × 1/frame rate.

For example, with a 120 degree sector (shutter opening ⅓) and with 4000 frames/second, the exposure time is 1/12,000 second. With a detonation wave speed of 1800 meters/second (5900 feet/second), the front moves (smears) 1/7 meter. The smear width is too large to make precise measurements of the width of the reaction zone.

In a worst possible situation, the pin-registered framing camera at 500 frames/second exposes the frame for 1/1500 second and the front moves 6/5 meters; this situation during that time, gives a wide, bright smear. As stated above, a pin-registered framing camera may totally fail to capture even one frame of the detonation event.

The use of ¼ pound of a high explosive as an initiator is preferred for most experiments. The advantage of retaining the initiator mass small is that its fireball is small, relative to the diameter of the cloud. There is more unreacted fuel-air cloud for the detonation wave to pass through. With a well-tested situation, a ⅛ pound charge is a preferable mass. In testing for the detonability of new fuels, it is better to use ½ to ¾ pound of initiator, and accept some loss in unreacted cloud size, so as not to hastily conclude a fuel will not detonate.

Having thus described a specific preferred embodiment of the invention, it will be appreciated by those skilled in the art that variations are possible within the scope of the invention. For example, the camera-bottle geometrical arrangement of the present invention can be modified by mounting the fuel bottle in a high aerial position and the ground-based camera could be pointed operationally in an upward direction to the elevated bottle. Further, the process is not deemed limited to the fuel bottle described herein. Consequently, it is intended that the invention not be limited to the disclosed embodiment as illustrated in the drawings and described in the specification, but rather that it be defined solely in accordance with the appended claims.

What is claimed is:

1. A process for detecting a detonation wave in a fuel-air mixture for use in a detection structural arrangement including a high-speed photographic camera means and a fuel-air explosive apparatus; said apparatus including a standard sized, plastic beverage bottle; a liquid fuel; a plastic burster tube; a detonator; a detonating cord; and a sealant tape; wherein said bottle contains therein said liquid fuel; wherein said burster tube contains therein said detonator and said detonating cord; wherein said burster tube and its content are inserted into the open end of said bottle; and wherein said sealant tape facilitates a snug fit of said burster tube within said bottle; said process including the steps of:

said fuel-air explosive apparatus being operatively mounted in an elevated horizontal location whereby the longitudinal axis of said bottle is in a plane parallel to the earth plane;

said camera means being operatively mounted at a location in the range of 50 to 150 feet from said fuel-air explosive apparatus with the line-of-sight axis of said camera means substantially parallel to and adjacent to the longitudinal axis of said bottle;

directing and focusing said camera means at the bottom or top end of said bottle until a speed in the range of 3500 to 4500 frames/second for said camera means being achieved and continuous filming being commenced operatively firing said burster tube, resulting in a burster tube explosion and the breakage of said bottle, a burster tube explosion, and a growth formation of a white disk-shaped fuel-air cloud continuing until the force of said burster explosion being dissipated and said growth fuel-air cloud being in a tentative detonation condition; firing a proximate charge within said growth fuel-air cloud whereby a detonation wave condition occurring within said fuel air mixture; and recording and processing said photographic film for proving or disproving the existence of a detonation wave.

2. A process for examining, measuring, and confirming the existence of a detonation wave in a fuel-air mixture using a substantially ground-based detection arrangement means including a high-speed photographic camera means; and a fuel-air explosive apparatus; said apparatus including a bottle; a liquid combustible fuel; a burster tube; a detonator; a detonating cord; and a sealant means; wherein said bottle contains therein said liquid combustible fuel; wherein said burster tube contains therein said detonator and said detonating cord; wherein said burster tube and its content are inserted through the opening of said bottle; and wherein said sealant means facilitates a sealing of said burster tube within said bottle; said process including the steps of:

said fuel-air explosive apparatus being operatively supported in a low and slightly elevated horizontal location with respect to said earth plane whereby the centerline of the longitudinal axis of said bottle being parallel to the earth plane;

said camera means being operatively mounted at a location in the range of 50 to 150 feet from said fuel-air explosive apparatus in the same low earth plane as said fuel-air explosive apparatus;

focusing said camera means directing at the bottom or top of said bottle until a speed in the range of 3500 to 4500 frames/second for said camera means being achieved and continuous filming being commenced;

operatively firing said burster tube, resulting in the breakage of said bottle, a burster tube explosion, and a growth formation of a white disk-shaped fuel-air cloud continuing until the force of said burster explosion being disseminated and said growth fuel-air cloud being in a detonation condition;

firing a proximate charge within said growth fuel-air cloud whereby a tentative detonation wave condition occurring within said fuel-air mixture; and recording and processing the photographic film of said camera means for proving or disproving the actual existence of a detonation wave.

3. A process for examining, measuring, and confirming the existence of a detonation wave in a fuel-air mixture for use in a ground-based detection system including a high-speed photographic camera means; and a fuel-air explosive apparatus;

said apparatus including a bottle means; a liquid combustible fuel;

a sealed burster tube means; and a detonator means; wherein said bottle means contains therein said liquid combustible fuel; wherein said burster tube means contains therein said detonator means; and wherein said burster tube means are inserted into the open end of said bottle means;

said process including the steps of:

said fuel-air explosive apparatus being operatively supported in a horizontal location whereby the longitudinal axis of said bottle means is in the plane parallel to the earth plane;

said camera means being operatively mounted in an operative range of said fuel-air explosive apparatus with line-of-sight axis of said camera means substantially parallel to said bottle means in the same earth plane as said fuel-air explosive apparatus;

focusing said camera means at end of said bottle means until an operative speed for said camera means being achieved and continuous filming being commenced;

operatively firing said burster tube, resulting in the breakage of said bottle means, a burster tube means explosion, and a growth formation of a white disk-shaped fuel air cloud continuing until the force of said burster explosion being dissipated and said growth fuel-air cloud being in a detonation condition;

firing a proximate charge means within said growth fuel-air cloud whereby a tentative detonation wave condition occurring within said fuel-air mixture; and processing and recording photographic film of said camera means for proving or disproving the actual existence of a detonation wave.

* * * * *